US005663539A

United States Patent [19]

Powell et al.

[11] Patent Number: 5,663,539

[45] Date of Patent: Sep. 2, 1997

[54] PASSENGER TRANSFER, DOUBLE DECK, MULTI-ELEVATOR SHUTTLE SYSTEM

[75] Inventors: Bruce A. Powell, Canton; Richard C. McCarthy, Simsbury; Joseph Bittar, Avon; Frederick H. Barker, Bristol; Samuel C. Wan, Simsbury; Paul Bennett, Waterbury; Anthony Cooney, Unionville; John K. Salmon, deceased, late of South Windsor, all of Conn., by Lucy Mary Salmon, executrix

[73] Assignee: Otis Elevator Company, Farmington, Conn.

[21] Appl. No.: 564,697

[22] Filed: Nov. 29, 1995

[51] Int. Cl.[6] ..... B66B 1/18; B66B 1/00; B66B 9/00

[52] U.S. Cl. ..... 187/385; 187/902; 187/249; 187/400

[58] Field of Search ..... 187/902, 385, 187/249, 400

[56] References Cited

U.S. PATENT DOCUMENTS 1,939,729 12/1933 Stark ..... 187/1

FOREIGN PATENT DOCUMENTS 6100272 4/1994 Japan .
6115857 4/1994 Japan .

OTHER PUBLICATIONS

Vogel, Robert M., "Elevator Systems of the Eiffel Tower 1889", United States National Museum Bulletin 228, p. 38.

*Primary Examiner*—Robert Nappi

[57] ABSTRACT

Double deck elevator cars (10–12) are moveable in corresponding adjacent overlapping hoistways (7–9). Passengers entering the bottom deck (39) from a ground landing are transferred into the bottom deck (47) of a second elevator as passengers in the upper deck (46) of the second elevator are transferred to the upper deck (38) of the first elevator. Passengers in the lower deck (31) of a third elevator (10) are transferred to a lower landing (33) as passengers in an upper landing (32) enter an upper deck (30) of the third elevator. Passengers are thereafter transferred in the same fashion between the second elevator and the third elevator at a second transfer level (49).

11 Claims, 4 Drawing Sheets

FIG. 1
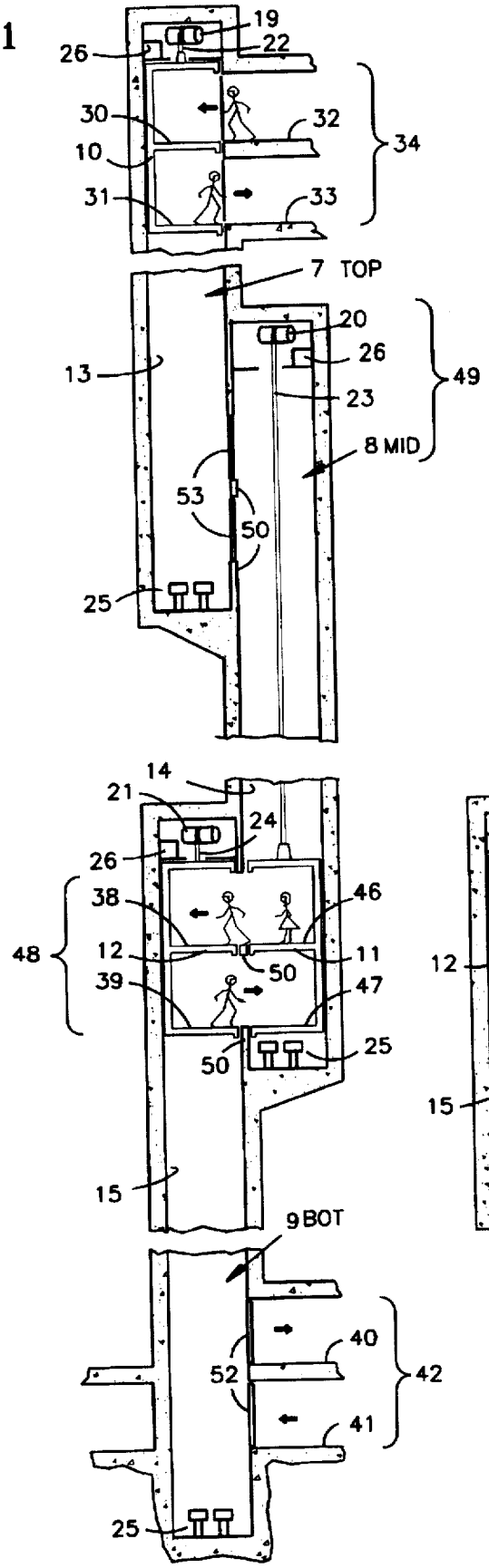
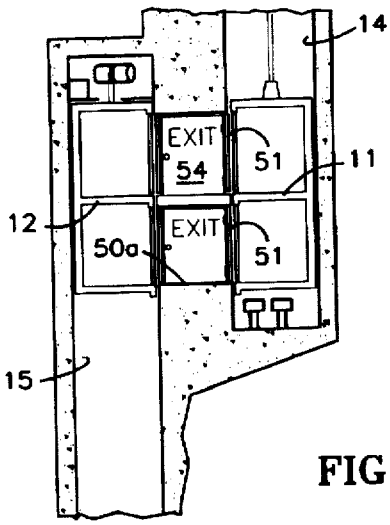
FIG. 2

PASSENGER TRANSFER, DOUBLE DECK, MULTI-ELEVATOR SHUTTLE SYSTEM

TECHNICAL FIELD

This invention relates to moving passengers in very tall buildings by having adjacent, overlapping hoistways with double deck elevators therein, and causing the passengers to move from a lower deck of one elevator to the lower deck of another elevator simultaneously with moving from the upper deck of the other elevator to the upper deck of the one elevator.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and energy consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in a commonly owned, copending U.S. patent application Ser. No. 08/564,754, filed contemporaneously herewith.

However, such a system is technically complex and costly. Furthermore, the cab is only moving in one hoistway at a time, the other one or more hoistways having idle car frames awaiting a cab; therefore, such a system does not utilize core fully.

DISCLOSURE OF INVENTION

Objects of the invention include moving passengers in a building greater vertical distances than the limit of length of a conventional elevator, in a simple and effective manner, without wasting core.

According to the invention, passengers are moved in a lower deck of a double deck elevator in a first hoistway from a first landing in a direction toward a second landing while simultaneously passengers are moved toward said first landing in an upper deck of a second double deck elevator in a second hoistway adjacent the first hoistway, and the passengers in the lower deck of the first car move to the lower deck of the second car as the passengers in the upper deck of the second car move to the upper deck of the first car, and then the passengers in the lower deck of the second car are moved toward the second landing while passengers in the upper deck of the first car are moved toward the first landing.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is a partially broken away, partially sectioned, simplified side elevation view of an elevator shuttle system in accordance with the present invention.

FIG. 2 is a partial, partially sectioned simplified side elevational view of an alternative embodiment of the invention.

BEST MODE FOR CARRYING OUT THE INVENTION

Figure 3:
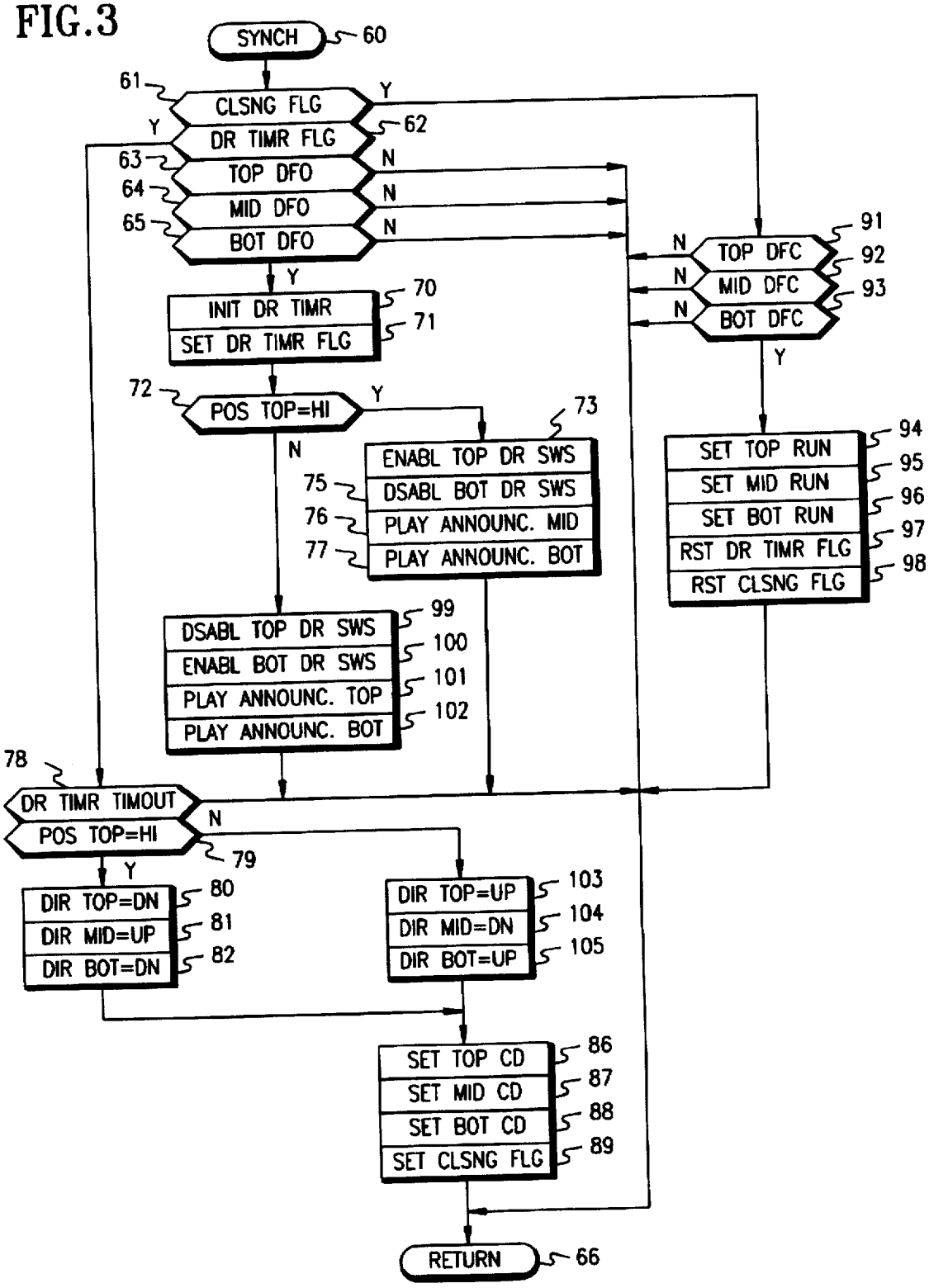
FIG. 3 is a logic flow diagram of a synchronization routine for operating elevators within the shuttle of the present invention.

Referring to FIG. 1, an elevator shuttle system includes a top elevator 7 which overlaps with a middle elevator 8 which in turn overlaps with a bottom elevator 9. Each of the elevators has a double deck car 10–12 which is moved vertically in hoistways 13–15 by hoist motor/brake assemblies 19–21 connected thereto by the usual roping 22–24. Each elevator has the usual buffers 25 and controller 26, which provide the usual motion and other car controls, one of which may serve as a controller for the shuttle group as a whole.

When the position of the car 10 is the high end of its hoistway 13 as shown, its upper and lower decks 30, 31 each of which comprises a passenger compartment, are aligned with upper and lower landings 32, 33 of a summit level 34 of the building. Similarly, when the position of the car 12 is the low end of its hoistway 15, its upper and lower decks 38, 39 (passenger compartments) are aligned with upper and lower landings 40, 41 of a ground level 42 of the building. When the position of the car 12 is the high end of its hoistway 15, the position of the car 11 will, in accordance with the invention, be the low end of its hoistway 14 as shown, and the upper and lower decks 38, 39 of the car 12 will be aligned with the upper and lower decks 46, 47 (passenger compartments) of the car 11 at a lower transfer level 48. When the position of the car 10 is the low end of its hoistway 13, the position of the car 11, in accordance with the invention, will be at the high end of its hoistway 14, and the upper and lower decks 30, 31 of the car 10 will be aligned with the upper and lower decks 46, 47 of the car 11 at any upper transfer level 49. One aspect of the invention, described more fully with respect to FIG. 3, is synchronizing of the running of the cars 10–12 so that (in the embodiment of FIG. 1) the car 11 always comes to rest at an end of its hoistway with one of the cars 10, 12 aligned therewith.

According to the invention, as each car moves from one end of its hoistway to the other, it will be carrying passengers in either the upper deck, or the lower deck, but not both. According to the invention, passengers will enter at one of the building levels 34, 42 from an upper landing onto an upper deck of an elevator and will transfer to the upper deck of two other elevators before departing at an upper landing of one of the levels. Similarly, passengers will enter the shuttle from the lower deck of one of the levels 34, 42 transfer to the lower deck of two additional elevators, and depart onto the lower deck of the other level. As shown in FIG. 1, at the ground level, the lower landing 41 is used as an entrance and passengers traveling upwardly are always in the lower deck of one of the cars 10–12. As shown in FIG. 1, the upper landing 32 of the summit level 34 is used as an entrance landing and passengers entering at the summit landing will enter the upper deck of the elevator 10, transfer to the upper deck of the other two elevators, and emerge at the upper landing 40 of the ground level. However, it is obvious that the upper decks could be used for upward traveling and the lower decks could be used for downward traveling, if desired.

In FIG. 1, hoistway doors 52 are shown at the ground level 42, because these doors are closed. Hoistway doors at the summit level 34 are not shown because they are open. Similarly, car doors 51 for the cars 10–12 are shown closed in FIG. 2, but not shown in FIG. 1 since they are open. The cars 10 and 12 could have rear doors and the landing levels 34, 42 could be on the opposite sides of the hoistways 13, 15. As is described more fully hereinafter, hoistway gates may be utilized to ensure passenger safety in the event that one of the elevator cars reaches a transfer level before the other elevator car, and the car doors become open. The hoistway gates would prevent inadvertent entrance into the opposing hoistway. No such gates are shown at the lower transfer level 48 because, if the gates were present in an embodiment of the invention, they would be open at the time indicated in FIG. 1. At the upper transfer level 49, hoistway gates 53 are shown in a closed position. The hoistway gates 53 (and similar gates at the lower transfer level 48) may comprise sets of ordinary hoistway doors 52 (FIG. 2), the same as the hoistway doors 52 used at the lower landing 42 (FIG. 1), with the hallway side of the hoistway doors facing each other across the sill. Thus, should one elevator arrive at a transfer floor before the other and open its car doors and associated hoistway doors, the other hoistway doors will remain closed until the second elevator car appears to open them. This is the most typical embodiment of the present invention. Or, a single, special gate may be used at each landing, operated separately from the car doors (which however can remain conventional). The operation of such a special gate is described with respect to FIG. 5, hereinafter. On the other hand, the invention can be practiced in other embodiments with no hoistway gates at all, as is described with respect to FIG. 4, hereinafter.

In accordance with the invention, the elevator shaft 14 is essentially contiguous with both of the other elevator shafts 13, 15. In one form of the invention, the shafts are separated by the minimal amount permitted in order to allow safe passage of cars past each other as each approach and depart from the corresponding end of the respective hoistway. As depicted in FIG. 1, when two elevator cars are aligned with each other, they are separated only by narrow sills 50. In FIG. 1, the sills 50 are very narrow, on the order of ¼ of a meter, so that the cars are very close together and the passengers can step from one car into the next. However, if necessary or desirable in any utilization of the invention, wider sills **50*a* may be utilized as illustrated in FIG. 2, to permit having an emergency exit 54 at the passenger transfer level. The definition of "sill" is, therefore, concerned less with its hoistway-to-hoistway width than with the fact that the passageway between upper decks of cars and the passageway between lower decks of cars provide only for transfer from one car to another (with the possible exception of an emergency exit door). That is to say, the purposes of the invention, smooth flow of passenger traffic which reduces travel time and passenger anxiety, are achieved with car-to-car passages which offer no choice but flow of foot traffic in a single direction from one car to the other. In this way, not only does passenger traffic flow readily from one car to the next, but additional passenger traffic does not become intermixed therewith: passengers will not board the shuttle system for the first time at one of the transfer levels 48, 49**.

Referring now to FIG. 3, a routine which may be used in a controller that controls the shuttle group for synchronizing the group, may be entered through an entry point 60. Each of the cars 10–12 will be advanced by its own motor in the hoistway in accordance with a motion profile, brought to rest at the destination level, and its doors will be opened, all in a usual way. The control of FIG. 3 senses the point in time when all three elevators are standing still with their doors open. In FIG. 3, a first pair of tests 61, 62 determine if locally used flags (described hereinafter) are set or not. Initially they will not be, so a series of tests 63–65 are reached to see if all three cars (top, middle and bottom) have their doors fully open, or not. If the doors are not fully open on any car, a corresponding one of the tests 63–65 will be negative, causing other programming of the controller to be reverted to through a return point 66. When all three cars have their doors open, a step 70 initiates a door timer which will determine how long the doors remain open, and a step 71 sets a door timer flag, indicating that the timer has been initiated. Then a test 72 determines if the position of the top car is high, as shown in FIG. 1. If it is, an affirmative result of test 72 reaches a step 73 to enable the top door switches so that passengers can reopen the door for a late arriving passenger, if necessary, and a step 74 disables the bottom elevator door switches so that passengers cannot control the doors at the transfer level 49. And then a pair of steps 76, 77 command that an announcement be played on the middle elevator and on the bottom elevator, respectively. The announcement is to the effect that the passengers should please walk from this car to the adjacent car. This feature need not be used if not desired in any implementation of the present invention. And then other programming is reached through the return point 66.

In the next subsequent pass through the routine of FIG. 3, test 61 is negative but test 62 is now positive since the door timer flag has just been set in the step 71. Until the door timer times out, negative results of a test 78 will cause other programming to be reached through the return point 66. Eventually, the door timer will time out and a subsequent pass through the routine of FIG. 3 will have a positive result of test 78 reaching a test 79 to determine whether the position of the top car is the high end of its shaft, as shown in FIG. 1. Assuming that it is, an affirmative result of test 79 reaches a series of steps 80–82 to set direction for the top car to down, direction for the middle car to up, and direction for the bottom car to down. When direction for each elevator has been accomplished, a series of steps 86–88 send a close door command to the respective top, middle and bottom cars to commence door closure, which is effected in the usual fashion by a cab controller. Then, a step 89 sets a closing flag so as to indicate that the doors are in the process of closing, and other programming is reverted to through the return point 66.

In the next subsequent pass through FIG. 3, test 61 is now affirmative since the closing flag was set in step 89 as the doors begin to close. Then a series of tests 91–93 determine when all of the doors are fully closed. In each pass through FIG. 3, as the doors are closing, a negative result of any of tests 91–93 cause other programming to be reached through the return point 66. Eventually, all three sets of doors are closed and affirmative results of tests 91–93 reach a series of steps 94–96 to tell each of the elevators it is now time to run. Then, a pair of steps 97, 98 reset the door timer flag and the closing flag to ready them for use at the next stop.

Once each elevator is commanded to run, in response to the signals sent by the steps 94–96, the top elevator will run down to the low end of its hoistway at the transfer level 49. The middle elevator will run up to the high end of its hoistway at the transfer level 49 and the bottom elevator will run down to the low end of its hoistway at the ground level 42. During the time that the elevators are moving, in each pass through the routine of FIG. 3, tests 61–65 are all negative reaching the return point 66 so that the remainder of FIG. 3 is bypassed. Eventually, the elevators will each come to rest and in the process will cause door open commands to be provided to its doors. Eventually, all of the doors will be opened so that negative results of tests 61 and 62 with affirmative results of tests 63–65 will reach the steps 70 and 71 to set the door timer and the corresponding flag. And then, test 72 determines if the top car is at the high end of its hoistway; in this case, it will not be, so a negative result of test 72 reaches a pair of steps 99, 100 to disable the top car door switches, so passengers will have no control over the doors at the transfer level 49, and to enable the door switches of the bottom car so that the passengers can accommodate late arrivals at the ground level 42. And a pair of steps 101, 102 cause the announcement (to walk to the other car) to be played. Then other programming is reached through the return point 66.

In the next subsequent pass through the routine of FIG. 3, test 61 is negative, test 62 is positive and test 78 will remain negative until the door timer times out. When it times out, it will reach test 79 to determine if the position of the top car is the high end of its hoistway. This time it is not, so a negative result of test 79 reaches a step 103 to command the direction for the top car to be up, a step 104 to command the direction for the middle car to be down, and a step 104 to command the direction of the bottom car to be up. Then the steps 86–89 are performed as before, and other programming is reverted to through the return point 66.

When the doors are fully closed, steps 94–98 are performed as before, and the process continues in the same fashion as the elevators go up and down.

In FIG. 3, only three tests 63–65 are used to determine when doors are fully open. Obviously, doors of both the upper and lower decks are included in those tests; and it is assumed that the fully open status of both sets of doors is utilized in the same fashion as would be for timing the doors in an ordinary double decker elevator. However, if desired, six tests may be used, one for each deck of each of the three elevators. Similarly, six tests may be used in place of the tests 91–93 to determine when all doors are fully closed and six commands to close doors can be provided in place of the steps 86–88. All of this is irrelevant to the present invention.

The embodiment of FIG. 1 includes only three elevators. The invention may be used with two elevators, four elevators or more. The embodiment of FIG. 1 shows the hoistway 13 disposed above the hoistway 15. This permits use of elevator cars having doors on only one side. However, if desired, the elevator car 11 can be provided with doors on both the front and the back of the car to permit placing the hoistway 13 to the right of the hoistway 14 as seen in FIG. 1, rather than being above the hoistway 15. The invention has been shown using double deck elevators, in which only one of the decks carries passengers in each run. However, in severe cases of restriction on elevator core, the elevator cars could have four or six decks within the purview of the present invention. In such a case, it would be immaterial as to whether all odd numbered decks are used for up travel and even numbered decks for down travel (or vice versa) or adjacent decks used for up travel and other adjacent decks used for down travel. So, as used herein, the term "double deck" means having two decks, or more, and references to "upper deck" and "lower deck" are construed to be references to any decks of an elevator, one above the other, carrying opposing traffic; thus, lower deck may mean the first, third, fifth, etc. while upper deck means the second, fourth, sixth, etc., or lower deck may mean the first through third while upper deck means the fourth through sixth, and so forth.

As used herein, the ground level 42 has two landings 40, 41, one being aligned with the upper deck and the other being aligned with the lower deck of an elevator standing at the ground level. Similarly, the summit level 34 comprises a landing level having upper and lower landings 32, 33 that are aligned with the upper and lower decks of an elevator stopped thereat. Thus, the term "landing level" encompasses both the upper and lower landings (or more) at a corresponding one of the levels 34, 42.

The invention has been shown and described for operation which assumes that the runs of each elevator take essentially the same time as each other elevator. While it is immaterial how long an elevator stays at a floor landing, such as at the summit level 34 and the floor level 42, passenger apprehension can be intolerable if passengers have to wait midway in a closed, still elevator, such as at the transfer levels 48, 49. If any of the hoistways have a different length than the others, the speed of the corresponding car can be adjusted so that run time will be essentially the same in each of them, within limits.

Details of the door opening and closing controls have not been shown because they are conventional, and door closing may be as disclosed, for instance in a commonly owned co-pending U.S. patent application Ser. No. (Attorney Docket No. OT-2230), filed contemporaneously herewith, except for the fact that door opening will occur in both directions of travel of all of the cars at all levels, and except for the fact that further constraints may be imposed upon opening doors at the transfer levels 48, 49, as described hereinafter.

Figure 4:
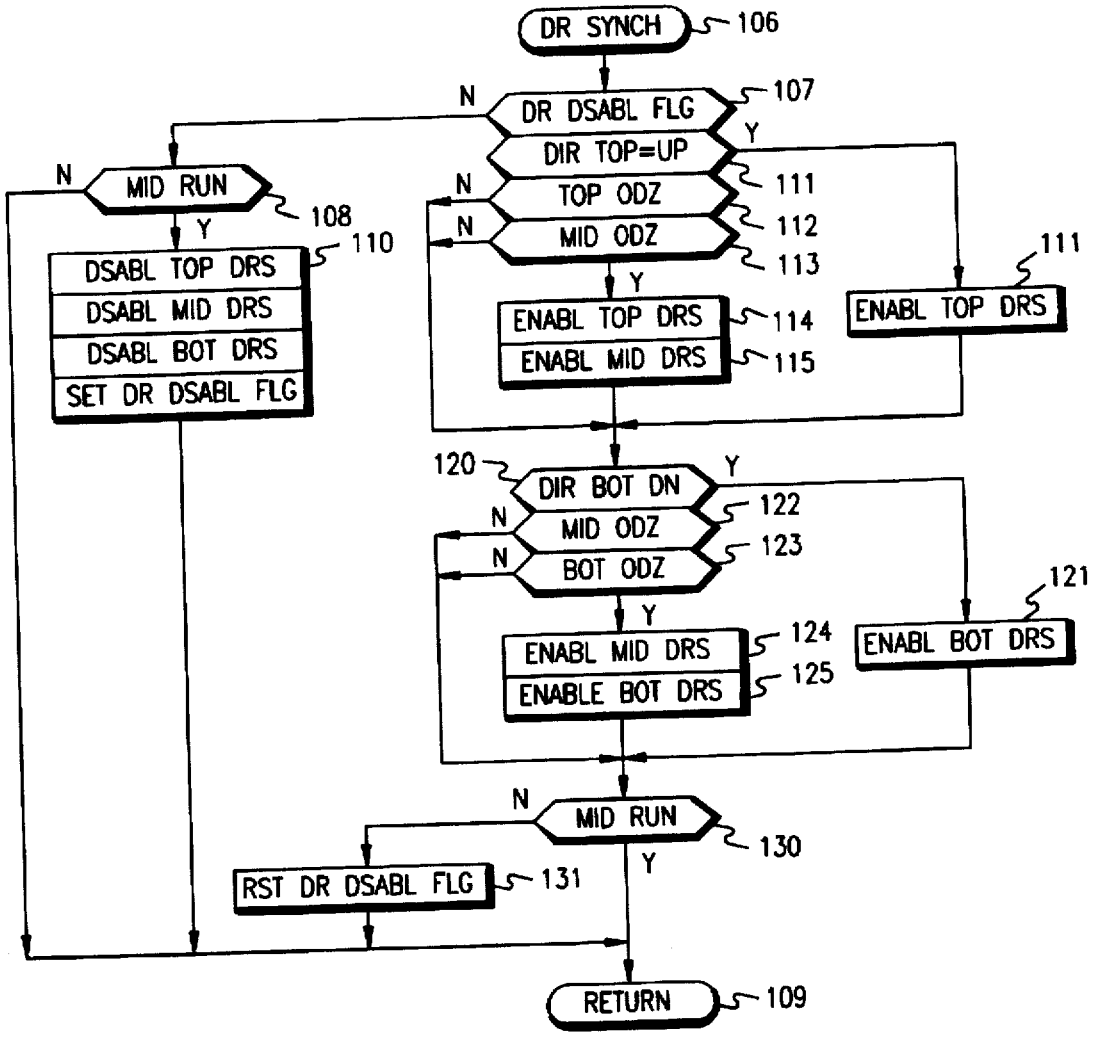
FIG. 4 is a logic flow diagram of a door synchronization routine which may be used for controlling elevator doors within the shuttle of the present invention.

For esthetics and to reduce passenger anxiety, and in any case where hoistway gates (door sets or a special gate) are not used, care should be taken to ensure that doors of the elevator cars are not opened at the transfer levels 48, 49 except when both cars are face-to-face and both are ready to open their doors. An additional door synchronization routine may be utilized, as described with respect to FIG. 4, reached through an entry point 106 where a first test 107 determines if the doors have been disabled already (as described hereinafter), or not. Initially, they will not have, so a negative result of test 107 reaches a test 108 to determine if the middle car is currently set to run, or not. If the middle car is not running, the remainder of FIG. 4 is bypassed, and other programming is reverted to through a return point 109. As soon as the middle car is enabled to run, in a subsequent pass through the routine of FIG. 4, a negative result of test 107 and a positive result of test 108 will reach a series of steps 110 which disable the top doors, disable the middle doors, disable the bottom doors and then set the disable flag. Then other programming is reached through the return point 109. In the next pass through the routine of FIG. 4, a test 111 determines if the direction of the top car is up, or not. If it is up, then it is known that the next stop will be at the landings of the upper level 34 and that it is therefore alright to allow the car's normal door controls to control the opening of the car doors. Therefore, an affirmative result of test 110 reaches a step 111 to enable operation of the doors in the top car. On the other hand, if the direction for the top car is not up, it is not known that it will be at a landing, and presumably the next stop will be at the upper transfer level 49. Therefore, it would be unsafe to open the car doors unless it is known that the other car is adjacent and its doors are opening. If the top car direction is not up, test 110 is negative and a test 112 determines if the top car is within its outer door zone of the upper transfer level yet. If it is, then a test 113 determines if the middle car is within its outer door zone of the upper transfer level. If both are, affirmative results of tests 112 and 113 reach a step 114 to enable door operation in the top car and a step 115 to enable door operation in the middle car. This process may slow the door opening a little; if desired, controls other than the outer door zone might be utilized to ensure that both cars will be present before opening the doors of either of them. If either the top or the middle car is not within its outer door zone, a negative result of either test 112 or 113 will cause the steps 114, 115 to be bypassed.

A step 120 determines if the direction of the bottom car is down, or not. If it is down, then the bottom car is headed for the landings at the ground level 42, and therefore it is permissible for the car to control its own door openings. An affirmative result of test 120 reaches a step 121 to enable the bottom car doors. But if the bottom car does not have a down direction, it presumably is headed for the lower transfer level 48. A test 122 determines if the middle car is within its outer door zone of the lower transfer level or not, and a test 123 determines if the bottom car is within its outer door zone of the lower transfer level or not. If both are within their outer door zones, then affirmative results of tests 122 and 123 reach a step 124 to enable operation of the middle car doors and a step 125 to enable operation of the bottom car doors. But if either the middle car or the bottom car is not yet within its outer door zone, a negative result of either test 122 or test 123 will bypass the steps 124, 125. A test 130 determines if the middle car is running or not. Prior to reaching the outer door zones, and after reaching the outer door zones, the middle car will still be running for a while, so an affirmative result of test 130 will cause other programming to be reached through the return point 109. While the car is running, once the disable flag is set, the routine of FIG. 4 will be performed periodically, even after the doors are enabled. Eventually, the doors will be opened by the other, normal functions of the respective elevator cars, and when the cars come fully to rest, the middle car will no longer be running. In that pass through the routine of FIG. 4, a negative result of test 130 will reach a step 131 to reset the door disable flag so that once the car does run again the doors can be disabled in anticipation of selective enablement as described hereinbefore. And then other programming is reached through the return point 109. With car doors synchronized in this manner, hoistway gates or doors need not be used at the transfer level.

Instead of either using sets of hoistway doors 54, or disabling the doors and thereafter reenabling them selectively, as in FIG. 4, if desired, special hoistway gates 53, 54 may be provided at the transfer levels 48, 49 between the shafts 13, 14 and 14, 15. Then either the coincidence of outer door zone (as in FIG. 4), or inner door zone, or otherwise, may be utilized to operate a special hoistway gate between the two cars. For instance, in FIG. 5, a gate routine is reached through an entry point 133 and a first test 134 determines if the middle car is running, or not. Assuming the situation in FIG. 1, the middle car is not running so a negative result of test 134 reaches a test 137 to determine if the position of the top car is the low end of its shaft. If so, a test 138 determines if the position of the mid car is at the high end of its shaft. If so, a pair of tests 140, 141 determine if the doors on both cars are no longer fully closed; that is, both are opening or open. If all of this is true, affirmative results reach a step 141 which causes the transfer gates 53 at the upper transfer level 49 to be opened. But if either car is not at the upper transfer level 49 or the door to either is still fully closed, a negative result of any of the tests 137–140 will cause step 141 to be bypassed, and the gates 53 between the two cars will remain closed at the upper transfer level 49. Similar tests 142–145 and step 146 will control the hoistway gates at the lower transfer level 48. After that, other programming is reverted to through a return point 147.

Figure 5:
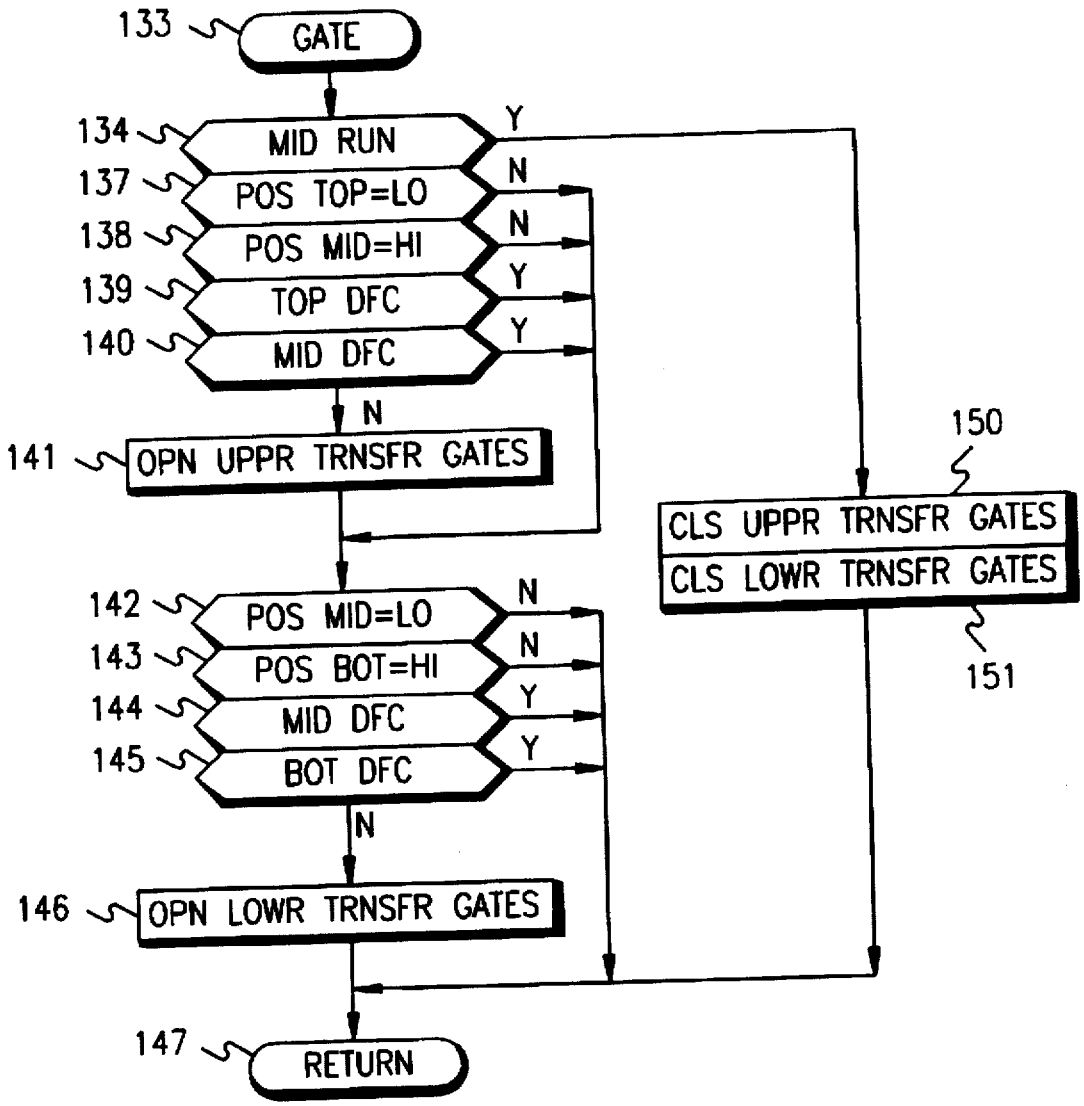
FIG. 5 is a logic flow diagram of a hoistway gate routine which may be used within the shuttle of the present invention.

In any embodiment in which the routine of FIG. 5 is used, the routine will be performed repetitively as described so long as the middle car has not been enabled to run. This will simply redundantly order the opening of one or the other of the transfer gates, which is harmless. If desired, a flag could be provided to avoid redundant performance of the routine of FIG. 5, once either of the transfer gates has been opened. Eventually, the passengers will be transferred and the doors closed, as described with respect to FIG. 3, and the middle car will again be set to run by the step 95. When this happens, the doors of the middle car and of whichever car was facing it will have already closed, and an affirmative result of the test 134 will reach a pair of steps 150, 151 to ensure that both of the transfer gates are closed. And then other programming is reached through the return point 147.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator shuttle system for moving passengers between landings at two levels of a building, comprising:

a plurality of overlapping elevator hoistways, each hoistway except for the highest hoistway in said system having its high end aligned with the high end of another, corresponding one of said hoistways at a transfer landing, and each hoistway except for the lowest hoistway in said system having its low end aligned with the high end of another, corresponding one of said hoistways, the high end of said highest hoistway being aligned with a landing at a top level of said system high in said building and the low end of said lowest elevator being aligned with a landing at a bottom level of said system low in said building;

a plurality of double deck elevator cars, each vertically moveable in a related one of said hoistways, each deck comprising a passenger compartment, each compartment comprising a permanent part of said car, one above the other, each of said cars having doors operable at each deck facing the corresponding hoistway, the cars of said highest hoistway and of said lowest hoistway having doors facing the corresponding one of said landings, each hoistway separated from a corresponding hoistway by a pair of sills aligned with said decks; and signal processing means for setting the direction of and initiating each run of said cars so that at the end of each run, each car is either aligned with one of said landings or aligned with the car of the corresponding hoistway, and for opening all of the doors of all of the cars at the end of each run so that passengers can walk from the upper deck of one car to the upper deck of another car and from the lower deck of said other car to the lower deck of said one car, or alternatively, from the upper deck of said one car to the upper deck of one of said landings and from the lower deck of said one landing to the lower deck of said one car.

2. A system according to claim 1 further comprising:

hoistway gates at the upper end of each of said hoistways except said highest hoistway and at the lower end of each of said hoistways except said lowest hoistway, said hoistway gates blocking passage over a related sill between corresponding hoistways; and means for opening said hoistway gates when the cars of said corresponding hoistways are aligned with each other.

3. A system according to claim 2 wherein:

said hoistway gates comprise hoistway doors, one at each sill for each hoistway, each hoistway door being opened and closed by the opening and closing of a related one of said car doors.

4. A system according to claim 2 wherein:

said hoistway gates each comprise a single gate disposed at each sill to block passage between corresponding hoistways.

5. A system according to claim 4 wherein said signal processing means comprises means responsive to the presence of two of said cars at one of said sills to open the corresponding gate.

6. A system according to claim 4 wherein said signal processing means comprises means responsive to the presence of two of said cars at one of said sills with the doors of both cars being not fully closed to open the corresponding gate.

7. A system according to claim 1 wherein said signal processing means comprises for enabling the opening of the doors of each car at a particular transfer level only if the car in the corresponding hoistway is within the outer door zone of said particular transfer level.

8. A system according to claim 1 wherein said signal processing means comprises means for enabling the opening of the doors of both cars at a particular transfer level only if both cars are within the outer door zone of said particular transfer level.

9. A system according to claim 1 wherein said signal processing means enables each of said cars to run only when all of said cars are ready to run.

10. A method of moving passengers between a first landing at a first level of a building and a second landing at a second level of said building, comprising:

(a) moving passengers in a lower deck of a first double deck elevator car within a first hoistway from said first landing in a direction toward said second landing while simultaneously moving passengers toward said first landing in an upper deck of a second double deck elevator car in a second hoistway adjacent to said first hoistway, each of said cars having doors facing the hoistway of the other car;

(b) bringing said first and second cars to rest with an upper deck of said first car aligned with the upper deck of said second car and with the lower deck of said first car aligned with a lower deck of said second car;

(c) opening the doors of both cars so that passengers in the lower deck of said first car can walk without interference from any other passengers directly to the lower deck of said second car and passengers in the upper deck of said second car can walk without interference from any other passengers directly to the upper deck of said first car; and (d) moving passengers in the lower deck of said second car toward said second landing while simultaneously moving passengers in the upper deck of said first car toward said first landing.

11. A method according to claim 10 further comprising the steps of:

(e) moving passengers from said second landing in an upper deck of a third double deck elevator car within a third hoistway adjacent to said second hoistway simultaneously with moving passengers in said lower deck of said second car toward said second landing, said third car having doors facing the doors of said second car;

(f) bringing said second and third cars to rest with the upper deck of said second car aligned with the upper deck of said third car and the lower deck of said second car aligned with a lower deck of said third car, substantially simultaneously with bringing said first car to rest with the upper deck of said first car aligned with a third landing at said first level and the lower deck of said first car aligned with said first landing; and (g) opening the doors of said second car and said third car so that passengers in the lower deck of said second car can walk without interference from any other passengers directly into the lower deck of said third car and passengers in the upper deck of said third car can walk without interference from any other passengers directly into the upper deck of said second car, while substantially simultaneously opening the doors of said first car so that passengers can exit the upper deck of said first car onto said third landing and passengers can enter into the lower deck of said first car from said first landing.

* * * * *